US006402105B1

(12) United States Patent
Hoyt et al.

(10) Patent No.: US 6,402,105 B1
(45) Date of Patent: Jun. 11, 2002

(54) DISPLAY HANGER

(75) Inventors: David Hoyt; Gary Aldcroft, both of Gardena, CA (US)

(73) Assignee: Principle Plastics

( * ) Notice: Subject to any disclaimer, the term of this patent is extended or adjusted under 35 U.S.C. 154(b) by 0 days.

(21) Appl. No.: 09/388,590

(22) Filed: Sep. 2, 1999

(51) Int. Cl.[7] ..... A47F 7/08
(52) U.S. Cl. ..... 248/215; 211/24; 211/113
(58) Field of Search ..... 211/34–38, 85.3, 211/113; 248/215, 309.1, 304, 339; 223/85, 87, 113; 2/271, 336; 206/292–296; 24/712, 712.1, 712.7; 40/322, 625, 631, 636, 661, 661.04, 663, 671

(56) References Cited

U.S. PATENT DOCUMENTS

| | | | | | |
|---|---|---|---|---|---|
| 1,270,811 | A | * | 7/1918 | Garant | 211/34 |
| 1,310,281 | A | * | 7/1919 | Clark | 211/34 |
| 1,361,056 | A | * | 12/1920 | Hickman | 211/113 |
| 1,567,036 | A | * | 12/1925 | Cavanna | 211/34 |
| 2,107,306 | A | * | 2/1938 | Pollinger | 211/34 |
| 2,690,571 | A | * | 10/1954 | Gamble | 211/34 |
| 2,710,489 | A | * | 6/1955 | Myers, Jr. | 40/332 |
| 2,965,237 | A | * | 12/1960 | Wells | 211/34 |
| 3,907,115 | A | * | 9/1975 | Satchell | 211/34 |
| 4,261,121 | A | * | 4/1981 | Coon | 40/332 |
| 4,669,615 | A | * | 6/1987 | Zigman | 211/34 |
| 4,823,962 | A | * | 4/1989 | Arias | 211/34 |
| 4,978,043 | A | * | 12/1990 | Uke | 223/85 |
| 5,114,017 | A | * | 5/1992 | Doyel | 211/34 |
| 5,163,590 | A | * | 11/1992 | Lawler et al. | 223/85 |
| 5,282,553 | A | * | 2/1994 | Ibled | 223/85 |
| 5,778,556 | A | * | 7/1998 | Ohsugi | 34/106 |
| 5,797,527 | A | * | 8/1998 | Lam | 223/85 |
| 5,911,347 | A | * | 6/1999 | Jackstat et al. | 223/85 |
| 5,931,314 | A | * | 8/1999 | Jackstat et al. | 211/34 |
| 6,010,044 | A | * | 1/2000 | Hsiao | 223/85 |

* cited by examiner

*Primary Examiner*—Daniel P. Stodola
*Assistant Examiner*—Jennifer E. Novosad
(74) *Attorney, Agent, or Firm*—James E. Brunton, Esq.

(57) ABSTRACT

A hanging display device for displaying pairs of shoes in a side-by-side relationship. The device includes spaced-apart resiliently deformable legs that can be conveniently inserted into the foot-receiving cavities of the shoes in a manner to support the shoes in a hanging relationship. The device also includes a center member that is disposed between the shoes and carries at one end a hook-like member that can be emplaced over a peg or hook provided on a display board. A display panel is affixed to the center member which spans the top of the shoes and provides ample space for displaying product information and promotional material.

5 Claims, 4 Drawing Sheets

DISPLAY HANGER

BACKGROUND OF THE INVENTION

1. Field of the Invention

The present invention relates generally to display devices for displaying merchandise. More particularly, the invention concerns a hanging display device for displaying pairs of shoes in a side-by-side relationship.

2. Discussions of the Prior Art

Merchandisers commonly use hanging display devices to display their wares. Frequently the display devices consist of cardboard or plastic display cards which are hung from a display board or from a hook and to which the product is suitably affixed. In many cases the product is held in position on the display card by encapsulating the product within shrink wrap or like enclosure material.

Certain type of shoes such as rubber and plastic gardening clogs and the like lend themselves to display on hanging type display devices. However, because of the size, weight and configuration of the shoes, conventional display cards are not well suited for display purposes. Further conventional display devices typically do not allow the customer to feel the goods. The hanging device of the present invention solves these problems by providing a uniquely formed plastic hanging device the leg portions of which are received within the foot receiving cavity of the shoes. The leg portions of the device are resiliently deformable so that the shoes can be mounted in a side-to-side relationship and conveniently hung on a display board or on a display hook by a hook-like hanger member that is integrally formed on the upper portion of the plastic device. In one form of the invention, a center member is disposed between the leg portions and extends therebetween. With this construction, a relatively large display panel can be affixed to a center member to prominently display promotional information concerning the shoes. With the leg portions in position within the shoes, the display panel can span the forward portions of the shoes to provide ample room to display the manufacturer's trademark and important sales information.

SUMMARY OF THE INVENTION

It is an object of the present invention to provide an attractive display device for displaying shoes such as garden clogs and the like in a side-by-side relationship.

Another object of the invention is to provide a display device of the aforementioned character in which the device includes spaced apart resiliently deformable legs that can be conveniently inserted into the foot receiving cavities of the shoes in a manner to support the shoes in a hanging relationship.

Another object of the invention is to provide a display device as described in the preceding paragraph which includes a center member that is disposed between the shoes and carries at one end a hook-like member that can be emplaced over a peg or hook provided on a display board.

Another object of the invention is to provide a display device of the character described in the preceding paragraphs that includes display panels of different shapes that can be removably affixed to the center member of the device in a plurality of locations so that the display panels attractively span the top of the shoes and provide ample space for displaying product information and promotional material.

Another object of the invention is to provide a display device for displaying shoes that is easy to use, is inexpensive to manufacture, is attractive and is durable in use.

DISCUSSIONS OF THE INVENTION

Figure 1:
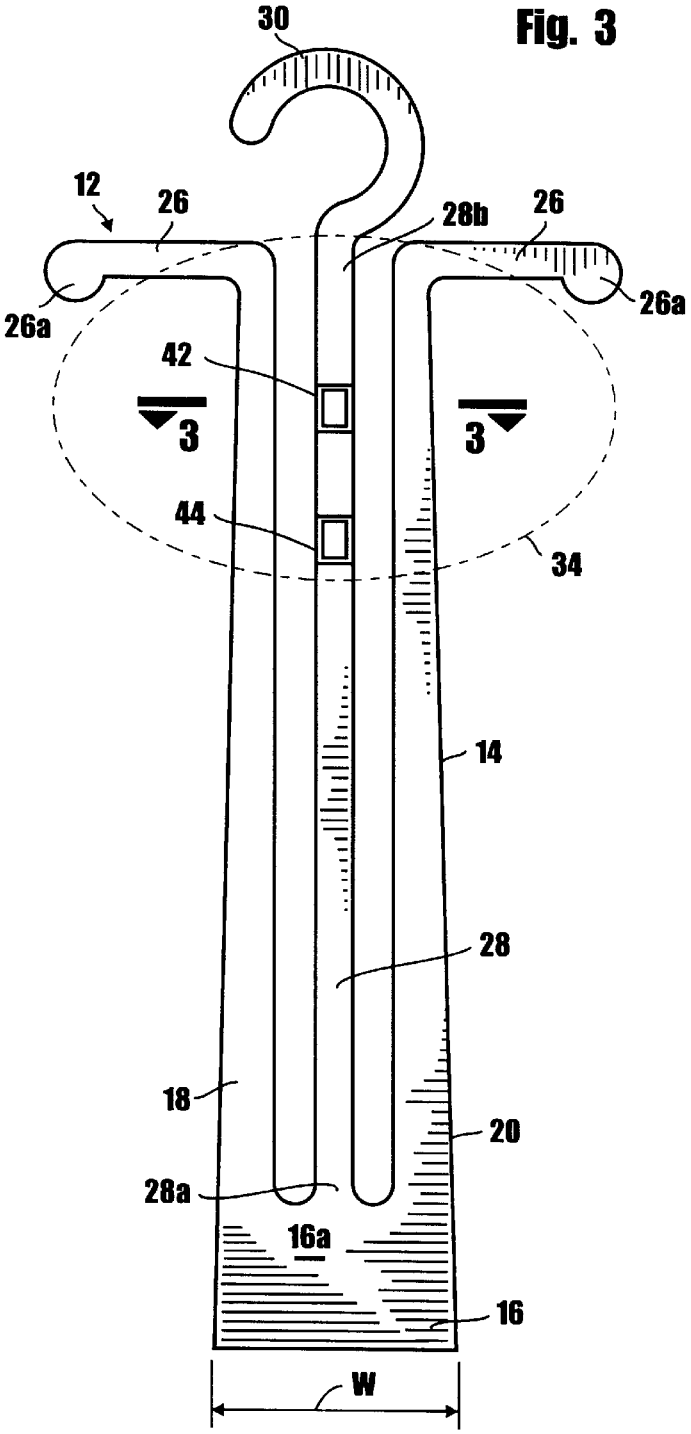
FIG. 1 is a front plan view of one form of the display hanger of the invention.
Figure 2:
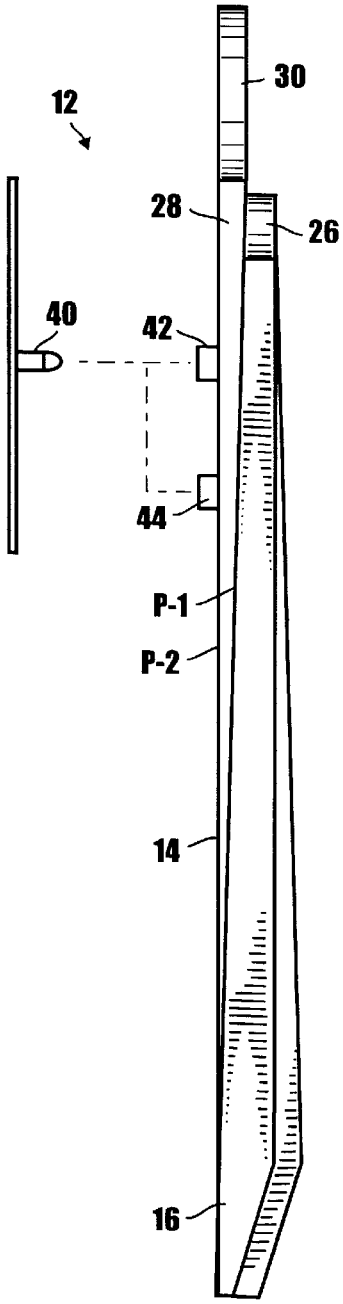
FIG. 2 is a side-elevational view of the hanger device shown in FIG. 1.
Figure 5:
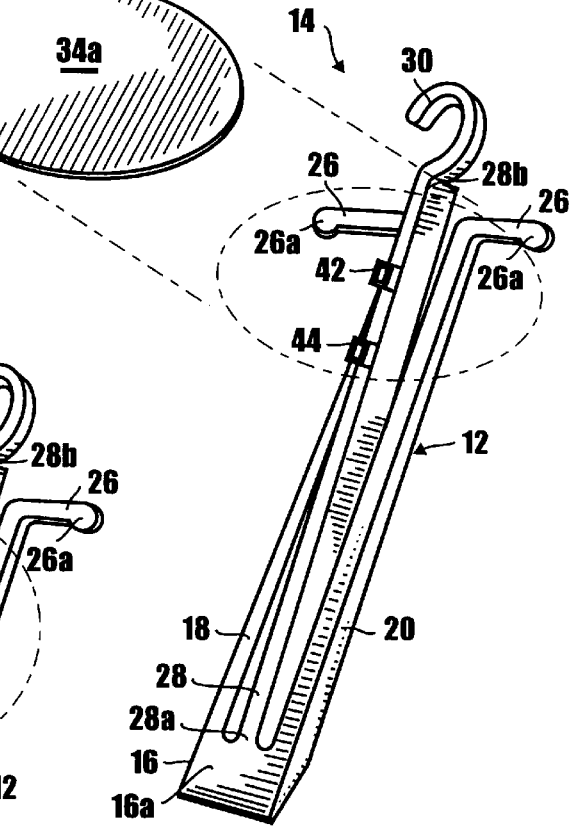
FIG. 5 is a generally perspective, exploded view illustrating the manner of removably affixing an alternate embodiment of the display panel to the central body portion of the device.

Referring to the drawings and particularly to FIGS. 1, 2, 6, and 7, one form of the display hanger of the present invention for displaying a pair of shoes is there shown and generally designated by the numeral 12. In the form of the invention shown in the drawings, the display hanger comprises a molded plastic body 14 having a generally planar connector segment 16 of a first width "W" (FIG. 1). Connected to and extending outwardly from connector segment 16 is a first side leg 18 that is disposed within a first plane "P-1" (FIG. 2). Also connected to connector member 16 and extending outwardly therefrom is a second side leg 20 which is also disposed within first plane "P-1" (FIG. 5). Provided proximate the second or outboard end of each of the side legs 18 and 20 is a perpendicularly outwardly extending foot-like member 26.

Figure 6:
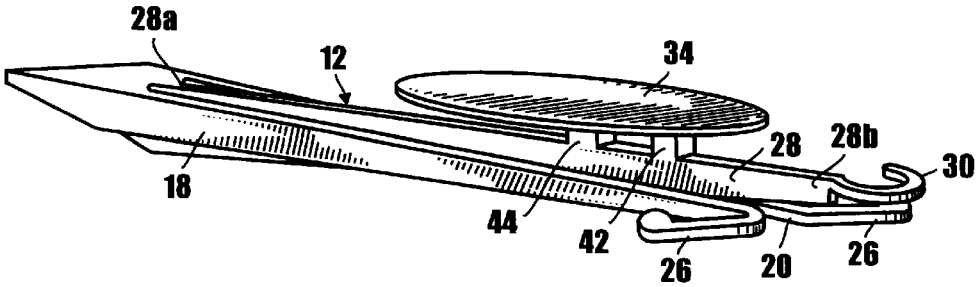
FIG. 6 is a generally perspective, side-elevational view of one form of the display hanger of the invention.

Disposed between the first and second side legs is a center member 28 which, as shown in FIG. 2, is disposed within a second plane "P-2" that extends angularly with respect to first plane "P-1" (see also FIG. 6). Center member 28 has a first end portion 28*a* which is affixed to connector segment 16 and a second end portion 28*b* to which hanger means, shown here as a hook-like connector member 30 is connected. Hook-like member 30 can conveniently be used to hang the display device from a peg or rod hook provided in the display area.

Figure 4:
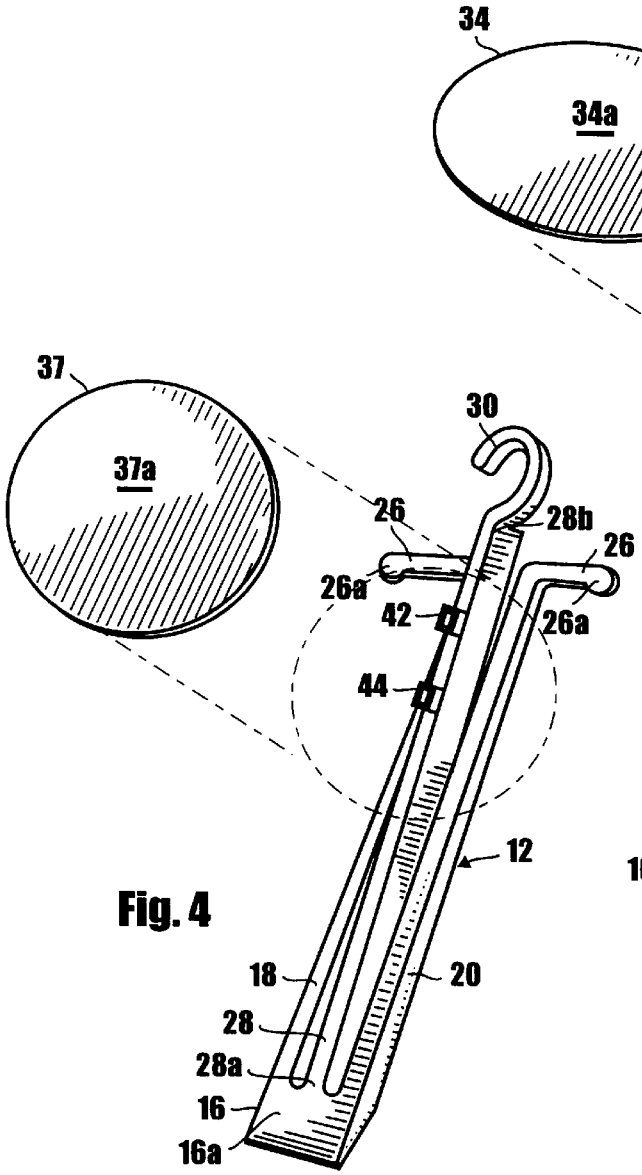
FIG. 4 is a generally perspective, exploded view illustrating the manner of use of removable affixing one form of the display panel of the invention to the central body portion of the device.
Figure 7:
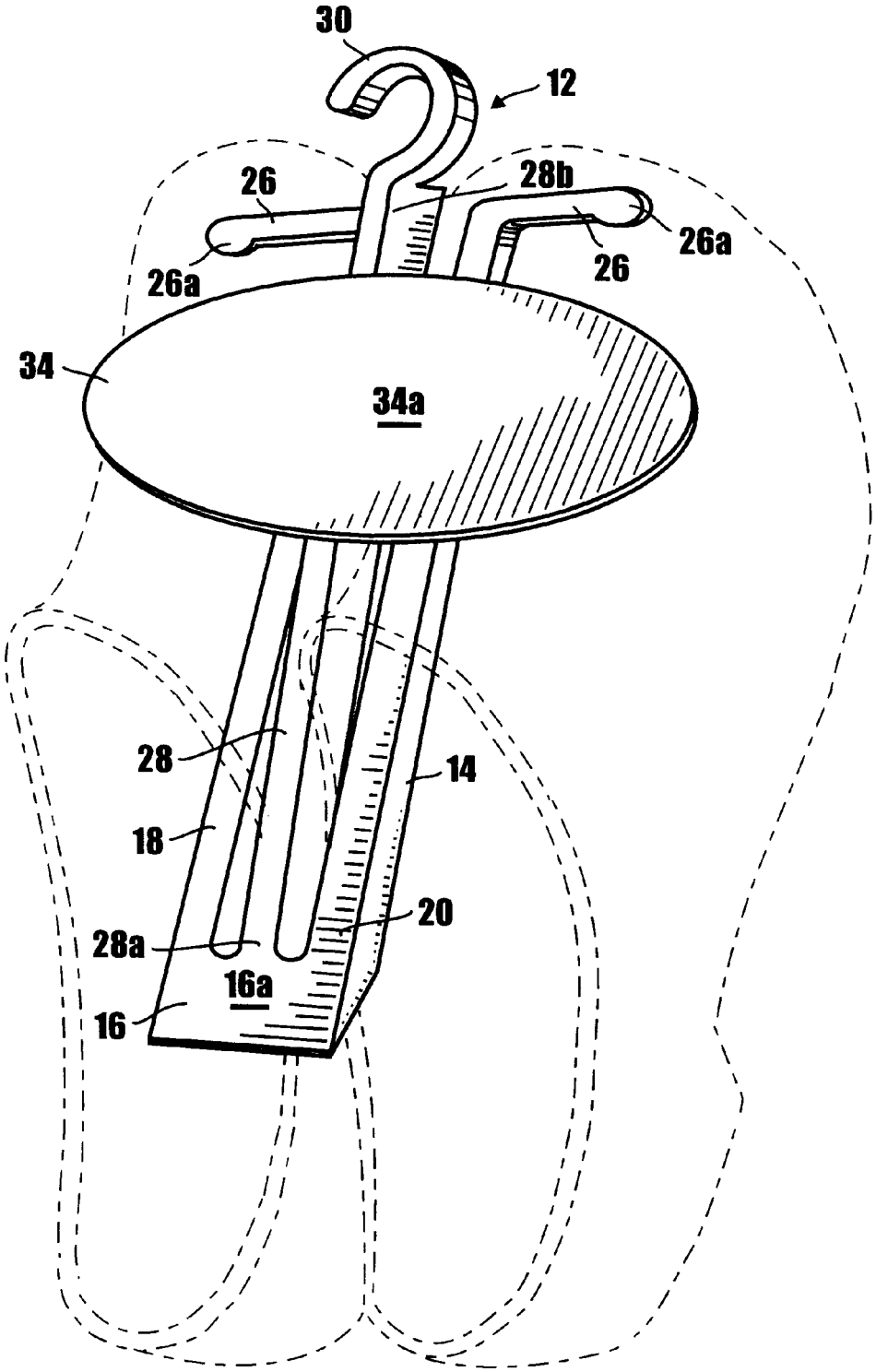
FIG. 7 is an enlarged, generally perspective view of the display hanger Illustrating its use to display a pair of garden clogs.
Figure 8:
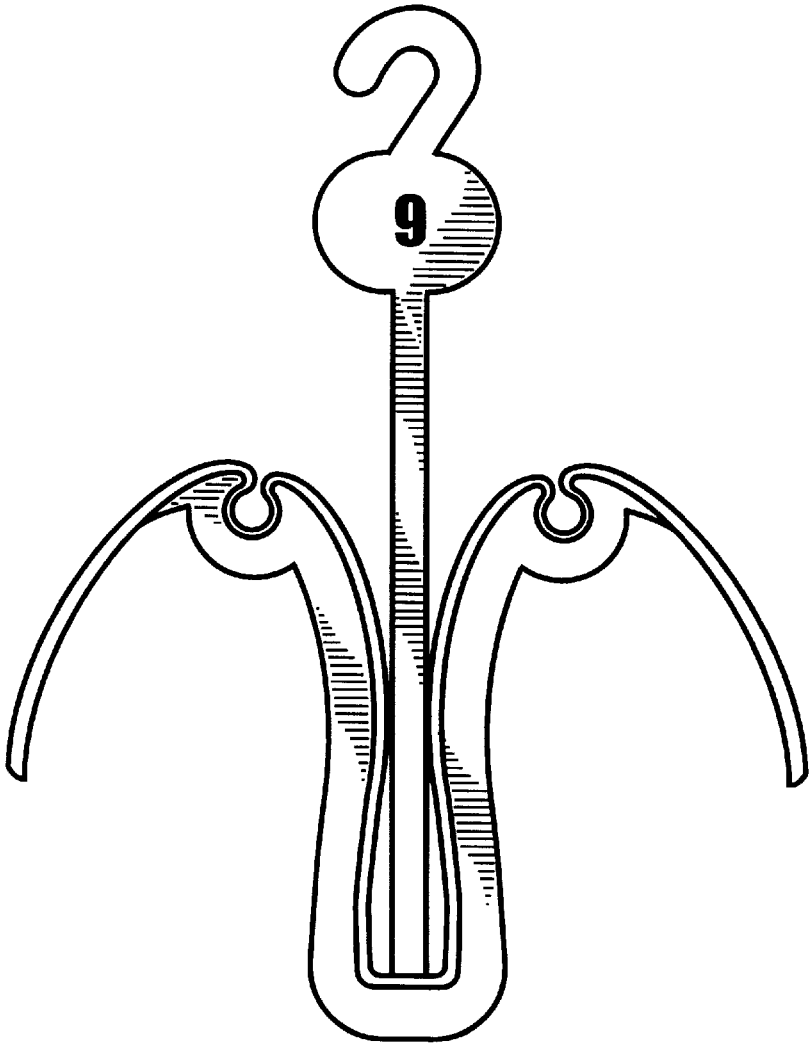
Fig. 8 [ Prior Art ]
FIG. 8 is a front plan view of a prior art display device.
Figure 9:
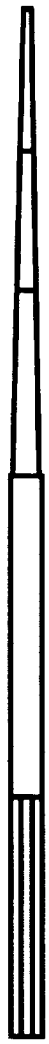
Fig. 9 [ Prior Art ]
FIG. 9 is a side elevational view of the prior art display device shown in FIG. 8.

Forming an important aspect of the display device of the present invention is the provision of a generally oval shaped display panel 34 which can be removably affixed to central leg 28 so that it spans side legs 18 and 20 in the manner shown in FIGS. 1 and 7. Display panel 34 includes a generally planar display face 34*a* upon which various indicia such as trademarks and product information can be imprinted. Importantly, display panel 34 is of a generous size to accommodate display of instructional material and is preferably of a width at least twice that of width "W" of connector segment 16. Connector segment 16 also has a generally planar face 16*a* upon which product information can be displayed. An alternate form of generally round display panel 37 can also be removably affixed to central leg 28 (FIG. 4). Panel 37 also has a generally planar display face 37*a*.

Figure 3:
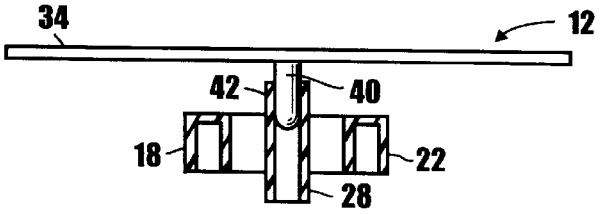
FIG. 3 is a cross-sectional view taken along lines 3—3 of FIG. 1.

Both of the display panels are provided with an outwardly extending connector element 40 which can be inserted into a selected one of two spaced-apart, socket-like members 42 and 44 formed on central leg 28 (see FIGS. 1, 2, and 3).

Connector element 40 and sockets 42 and 44 here comprise the connector means of the invention for removably connecting the display panels to the central leg 28. With the novel construction shown, the display panels can be affixed to central member 28 at the best location to accommodate the size and shape of the shoes being displayed.

As best seen by referring to FIG. 3, when the display device is in use, side legs 18 and 20 are received within the foot receiving cavity "C" of the pair of shoes "S" so that side legs 18 and 20 extend forwardly of the foot receiving cavity with foot portions 26 thereof spanning the forward or toe receiving portions "T" of the shoes to be displayed. When the hanger device is in position within the shoes in the manner described, the central leg 18 resides between the shoes and the display panel 30 conveniently spans the upper surface of the pair of shoes so that the indicia imprinted thereon is prominently displayed.

In the preferred form of the invention, body 14 of the hanging device is integrally formed of a molded plastic and is constructed so that side legs 18 and 20 are resiliently deformable relative to central leg 28 so that the side legs can be conveniently inserted into the toe-receiving cavities of the shoes with the perpendicularly outwardly extending feet portions 26 in secure frictional engagement with the toe portions of the shoes. In this regard, each foot portion 26 is preferably provided with a generally circular-shaped end portion 26*a* to aid in effectively gripping the toe portions of the shoes. With the display device thusly mounted within the pair of shoes, when the device is hung on a peg or like member, the pair of shoes will depend downwardly in the manner shown in FIG. 4. As previously mentioned, the display panels 34 and 37, which are of necessity separately molded from body 14, can be interconnected at one of two selected locations depending upon the configuration of the shoes being displayed.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A display hanger for displaying a pair of shoes in a side-by-side relationship, each shoe having side walls defining a foot receiving cavity having a forward portion and a heel portion, said display hanger comprising:

(a) a generally planar connector segment having a first width;

(b) a first side leg disposed within a first plane and capable of at least partially being received within the foot receiving cavity of one of said pair of shoes, said first side leg having a first end integrally formed with said connector segment and a second end having an outwardly extending foot for engagement with the forward portion of the foot receiving cavity;

(c) a second side leg disposed within said first plane and capable of being at least partially received within the foot receiving cavity of the other of said pair of shoes, said second side leg having a first end integrally formed with said connector segment and a second end having an outwardly extending foot for engagement with the forward portion of the foot receiving cavity;

(d) a center member located between said first and second side legs and disposed within a second plane extending angularly with respect to said first plane, said center member being located between the pair of shoes and having first and second ends, said first end being integrally formed with said connector segment;

(e) hanger means for hanging the display hanger connected to said center member proximate said second end thereof;

(f) a display panel affixed to said center member intermediate said first and second ends, said display panel spanning said first and second side legs and having a generally planar face for displaying indicia, said generally planar face having a second width at least twice said first width; and (g) connector means for removably connecting said display panel to said center member at a plurality of locations disposed in said center member.

2. The display hanger as defined in claim 1 in which said hanger means comprises a hook shaped member integrally formed with said center member.

3. The display hanger as defined in claim 1 in which said connector means comprises:

(a) a connector element extending from said display panel; and (b) a plurality of connector element-receiving sockets formed on said center member.

4. The display hanger as defined in claim 1 in which each said foot of said first and second side legs extends substantially perpendicularly outward.

5. The display hanger as defined in claim 1 in which said display panel generally oval shaped.

* * * * *